US006900782B2

(12) United States Patent
Tokunaga et al.

(10) Patent No.: US 6,900,782 B2
(45) Date of Patent: May 31, 2005

(54) PLASMA DISPLAY PANEL DRIVE METHOD

(75) Inventors: Tsutomu Tokunaga, Yamanashi (JP); Yoichi Sato, Fukuroi (JP)

(73) Assignees: Pioneer Corporation, Tokyo (JP); Shizuoka Pioneer Corporation, Shizuoka (JP)

( * ) Notice: Subject to any disclaimer, the term of this patent is extended or adjusted under 35 U.S.C. 154(b) by 384 days.

(21) Appl. No.: 10/151,177

(22) Filed: May 21, 2002

(65) Prior Publication Data

US 2003/0011540 A1 Jan. 16, 2003

(30) Foreign Application Priority Data

May 22, 2001 (JP) ..... 2001-152678

(51) Int. Cl.[7] ..... G09G 3/28

(52) U.S. Cl. ..... 345/60; 345/63; 345/66; 345/37; 345/41; 345/42

(58) Field of Search ..... 345/37, 41, 42, 345/60

(56) References Cited

U.S. PATENT DOCUMENTS 6,088,010 A * 7/2000 Makino et al. ..... 345/60
6,329,971 B2 * 12/2001 McKnight ..... 345/95
6,566,812 B1 * 5/2003 Torisaki et al. ..... 313/586
6,747,614 B2 * 6/2004 Takayama ..... 345/60

* cited by examiner

*Primary Examiner*—Sumati Lefkowitz
*Assistant Examiner*—Ming-Hun Liu
(74) *Attorney, Agent, or Firm*—Sughrue Mion, PLLC

(57) ABSTRACT

In the reset step for initializing an amount of wall charge in each of the plurality of discharge cells that define each of the picture elements in a plasma display panel, the number of reset discharges that are caused to occur in the discharge cells that handle the emission of light of at least one color within the picture element is greater than the number of reset discharges that are caused to occur in the discharge cells that handle the emission of light of the other color(s). The plasma display panel drive method provides a stable electrical discharge effect while increasing contrast.

14 Claims, 11 Drawing Sheets

PRIOR ART

PRIOR ART

FIG. 3A

| GRADATION LEVEL | LIGHT-EMISSION PATTERN | | | TOTAL PERIOD OF LIGHT EMISSION |
|---|---|---|---|---|
| | SF1 | SF2 | SF3 | |
| 1 | | | | 0 |
| 2 | ○ | | | 1 |
| 3 | | ○ | | 2 |
| 4 | ○ | ○ | | 3 |
| 5 | | | ○ | 4 |
| 6 | ○ | | ○ | 5 |
| 7 | | ○ | ○ | 6 |
| 8 | ○ | ○ | ○ | 7 |

○ : ILLUMINATED

PRIOR ART

FIG. 3B

| GRADATION LEVEL | LIGHT-EMISSION PATTERN | | | | | | | TOTAL PERIOD OF LIGHT EMISSION |
|---|---|---|---|---|---|---|---|---|
| | SF1 | SF2 | SF3 | SF4 | SF5 | SF6 | SF7 | |
| 1 | | | | | | | | 0 |
| 2 | ○ | | | | | | | 1 |
| 3 | ○ | ○ | | | | | | 2 |
| 4 | ○ | ○ | ○ | | | | | 3 |
| 5 | ○ | ○ | ○ | ○ | | | | 4 |
| 6 | ○ | ○ | ○ | ○ | ○ | | | 5 |
| 7 | ○ | ○ | ○ | ○ | ○ | ○ | | 6 |
| 8 | ○ | ○ | ○ | ○ | ○ | ○ | ○ | 7 |

○ : ILLUMINATED

PRIOR ART

PRIOR ART

PLASMA DISPLAY PANEL DRIVE METHOD

BACKGROUND OF THE INVENTION

1. Field of the Invention

The present invention relates to a plasma display device drive method.

2. Description of the Related Art

In recent years increases in the size of display screens of display devices have been accompanied by demands for the devices to be made thinner, and a variety of thin display devices have been reduced to practice. One area of particular interest in thin display devices is alternating-current discharge-type plasma display panels.

FIG. 1 of the accompanying drawings illustrates an overview of the structure of a plasma display device that contains such a plasma display panel.

In FIG. 1, a PDP (plasma display panel) 10 includes m column electrodes $D_1$ to $D_m$, and n row electrodes $X_1$ to $X_n$ and n row electrodes $Y_1$ to $Y_n$, laid out so as to intersect with the column electrodes. The row electrodes $X_1$ to $X_n$ and $Y_1$ to $Y_n$ form (define) the first display line through the nth display line in the PDP 10 using individual pairs of row electrodes $X_i$ ($1 \leqq i \leqq n$) and $Y_i$ ($1 \leqq i \leqq n$). Discharge spaces filled with an electrodischarge gas are formed between the row electrodes D and column electrodes X and Y. The various intersections between the respective row and column electrodes, which contain the electrodischarge spaces, are each structured with an discharge cell that emits red-colored light through electrodischarge, an discharge cell that emits green-colored light through electrodischarge, or an discharge cell that emits blue-colored light through electrodischarge.

Since each of the discharge cells produces its light through the use of an electrical discharge phenomenon, each discharge cell has only two possible states, either a "lit" state, which produces light at a specific brightness, or an "extinguished" state. In other words, only two brightness levels can be expressed. Given this, the drive device 100 functions as a gradation drive using a subfield method to provide intermediate gradation brightness displays corresponding to the inputted image (video) signals for the PDP 10, where the discharge cells are laid out so as to form a matrix.

In the subfield method, the display period (process) of a single field is divided into N subfields, and each subfield is assigned in advance a period over which the discharge cell is to continually emit light. For each of the subfields, each of the individual discharge cells is caused to emit light continuously over only the period that is assigned to the subfield, in response to the inputted image signal. This makes it possible to express various intermediate gradations of brightness levels (namely $2^N$ brightness levels) where N is the number of subfields (these brightness levels will be referred to as "gradations" below), through a combination of the subfields that are caused to emit light during the display period of a single field.

FIG. 2A and FIG. 2B of the accompanying drawings show examples of a light-emission drive format according to the subfield method described above.

In the light-emission drive format shown in FIG. 2A, the display period (process) for a single field is divided into three subfields, i.e., subfield SF1 through subfield SF3. In each of these subfields SF1 to SF3, there is a full reset process Rc, an address process Wc, and a light-emission sustaining process Ic. In the last subfield SF3 only, there is an erase (eliminate) process E.

In each of the full reset processes Rc, the drive device 100 applies a reset pulse with a positive polarity to each of the row electrodes $X_1$ to $X_n$ of the PDP 10 and also applies a reset pulse with a negative polarity to each of the row electrodes $Y_1$ to $Y_n$. The application of these reset pulses causes a reset discharge to occur in each of the discharge cells. When this occurs, the reset discharges cause the formation of a certain amount of wall charge that is uniform for all of the discharge cells when a selective erase (eliminate) address method (will be described below) is used. On the other hand, when a selective write address method (will be described below) is used, these wall charges that had been formed in all of the discharge cells are all eliminated.

The next process is the address process Wc. In the address process Wc, the drive device 100 selectively causes the discharge cells in respective horizontal raster lines (one line at a time) to discharge (referred to as "selective discharges") in response to the inputted image signal. The selective discharges proceed downwards from the top horizontal raster line. Each horizontal raster line (scanning line) is referred to as "display line". If a driving scheme based on the selective erase address method is used, residual wall charges are eliminated from within the discharge cells for those discharge cells in which the selective discharges take place, and the discharge cells become "extinguished discharge cells". On the other hand, in other cells for which the selected discharge are not caused, the wall charge that is formed during the full reset process Rc is maintained as it is, and the discharge cells become lit discharge cells. Alternatively, when a driving scheme based on the selective write address method is used, wall charges are formed in those discharge cells which are selected as discharge cells in the selective discharge process, and these discharge cells become lit discharge cells. On the other hand, no wall charge is formed in other discharge cells for which the selective discharge does not take place. These discharge cells therefore become extinguished discharge cells.

The subsequent process is the light-emission sustaining process Ic, in which the device drive 100 causes the discharge cells which have become "lit discharge cells" to continuously discharge (sustaining discharge) over a period that is assigned to the subfield concerned. The following periods are assigned to the light-emission sustaining process Ic of the respective subfields in the light-emission drive format shown in FIG. 2A.

SF1:1

SF2:2

SF3:4

Consequently, the total period of light emission resulting from the sustaining discharge performed during the single field display period can be one of eight types, from "0" to "7" as shown in FIG. 3A, depending on the pattern in which the subfields are combined to cause the emission of light. Because the human eye perceives brightness according to the period over which light is emitted per unit time, the drive based on the light-emission drive format as shown in FIG. 2A makes it possible to express eight gradations of brightness.

On the other hand, in the light-emission drive format shown in FIG. 2B, the display period (process) for a single field is divided into seven subfields SF1 to SF7. In each subfield, the address process WC and the light-emission sustaining process Ic are implemented as described above. In the light-emission drive format shown in FIG. 2B, the full reset process Rc, which is implemented for each subfield process in the drive in FIG. 2A, is performed only for the first subfield SF1. The light-emission sustaining processes Ic for the subfields SF1 to SF7 are assigned light-emission periods as follows:

SF1:1

SF2:1

SF3:1

SF4:1

SF5:1

SF6:1

SF7:1

When driving based on the light-emission drive format shown in FIG. 2B, the combination patterns of subfields related to light emission can cause eight patterns light-emission, as shown in FIG. 3B. In the light-emission drive format shown in FIG. 2B, the full reset process Rc is performed only in the first subfield SF1. Consequently, once a discharge cell is set to be an extinguished discharge cell in the address process Wc of a particular subfield, it becomes impossible to switch this discharge cell to an lit discharge cell in any of the subsequent subfields. In other words, in the light-emission drive format shown in FIG. 2B, the transition from a lit discharge cell state to an extinguished discharge cell state within a single field display period can occur a maximum of one time, as shown in FIG. 3B. The total period of light emission within the field display period can be one of eight types, from "0" to "7" as shown in FIG. 3B, depending on the combination patterns of the subfields wherein light is emitted. Accordingly, it is possible to express eight levels of intermediate gradations.

As described above, a drive based on the subfield method, as shown in FIGS. 2A, 2B, 3A and 3B, makes it possible to display, on the screen of the PDP 10, images that have intermediate gradations of brightness on an eight-level scale.

However, in display devices that display images through the use of light-emitting phenomena accompanying electrical discharges, such as plasma display panels, it is also necessary to have electrical discharges that are accompanied by the emission of light that is not part of the image to be displayed. In particular, because all discharge cells emit light at the same time due to the reset discharge that occurs at the full reset process Rc, there is a problem with a substantial reduction in contrast when displaying images that are not bright.

In consideration of this, the rising and falling edges of the reset pulses $RP_{x1}$ and $RP_{y1}$, which are applied to the row electrodes $X_1$ through $X_n$ and to the row electrodes $Y_1$ to $Y_n$ in order to cause the reset electrical discharge, are each made to be more gradual, as shown in FIGS. 4A and 4B of the accompanying drawings. FIG. 4A shows the various types of reset pulses applied to the PDP 10 in the full reset process Rc, along with the state of light-emission in each discharge cell ($C_R$, $C_G$, and $C_B$) when the PDP is driven using the selective erase (deletion, elimination) addressing method. FIG. 4B shows the various types of reset pulses that are applied to the PDP 10 during the full reset process Rc, along with the state of light emission in each discharge cell ($C_R$, $C_G$, and $C_B$) when the PDP is driven using the selected write address method. These reset pulses $RP_{X1}$ and $RP_{Y1}$, of which waveforms have gradual rising and falling transitions, cause the reset emissions (discharges) to be weaker, and thus reduce the amount of light that is emitted during the electrical discharge. This reduces (suppresses) the contrast deterioration when displaying a low-brightness image. However, the weaker the electrical discharge, the less adequate the amount of priming particles formed in the discharge space, and the less adequate the wall charge produced. This makes the selective discharge in the address process Wc unstable. In order to avoid this, a second reset pulse $RP_{X2}$ and a second reset pulse $RP_{Y2}$ are applied alternating between the row electrodes X and the row electrodes Y, as shown in FIG. 4A and FIG. 4B, immediately after the application of the reset pulses $RP_{X1}$ and $RP_{Y1}$. In this instance, an electrical discharge occurs in the discharge space each time the reset pulses $RP_{X2}$ and $RP_{Y2}$ are applied. Additionally, priming particles are produced and accumulated in the discharge space each time these discharges occur. As a result, enough priming particles are accumulated in the discharge space to stabilize the selective discharges.

However, due to the increase in the number of times there are discharges during the full reset process Rc, the amount of extraneous light not involved in the image creation increases. This causes a reduction in contrast.

SUMMARY OF THE INVENTION

An object of the present invention is to provide a plasma display panel drive method that produces a stable discharge effect while increasing contrast.

The plasma display panel drive method according to the present invention is a plasma display panel drive method that drives, for each of a plurality of subfields that constitute a single field of an image signal, a plasma display panel wherein a single picture element comprises a plurality of discharge cells that have mutually differing colors of light emission, the plasma display panel drive method comprising an address process that sets each discharge cell to either a lit discharge cell state or an extinguished discharge cell state by selectively causing electrical discharge to occur in said individual discharge cell based on said image signal, and a sustaining process that causes only the discharge cells in the lit discharge cell state to sustain electrical discharges for a number of times corresponding to the subfield(s). For at least one of the subfields, the method further includes a reset process that initializes all of the discharge cells into either said lit discharge cell state or said extinguished discharge cell state by causing all of said discharge cells to have rest discharge a certain number of times continuously prior to said address process. In at least one reset process in said field or said reset process(es) in one field of a plurality of fields, the number of the reset electrical discharge caused to occur in the discharge cell that is responsible for at least one color of emitted light within said picture element is greater than the number of said reset electrical discharge caused to occur in other discharge cells that are responsible for a different color of emitted light.

The drive method of the present invention sets the number of electrical discharges in the discharge cells that handle the emission of light of colors that are perceived as having a lower brightness level to be higher than the number of electrical discharges in the discharge cells that handle the emission of light of the other colors when the discharge cells are caused to have repetitive reset discharges in the reset process that initializes the wall charge formation state in all of the discharge cells.

Consequently, the present invention is able to generate an adequate amount of priming particles within all of the discharge cells while suppressing the amount of extraneous emitted light generated during the reset process, and thus provides increased contrast while insuring a stable discharge effect.

BRIEF DESCRIPTION OF THE DRAWINGS

FIG. 3A is a drawing showing an example of a light-emission pattern that is used in the light-emission drive format shown in FIG. 2A;

FIG. 3B is a drawing showing an example of a light-emission pattern that is used in the light-emission drive format shown in FIG. 2B;

DETAILED DESCRIPTION OF THE INVENTION

Embodiments of the present invention will be described in detail referencing the drawings.

Figure 5:
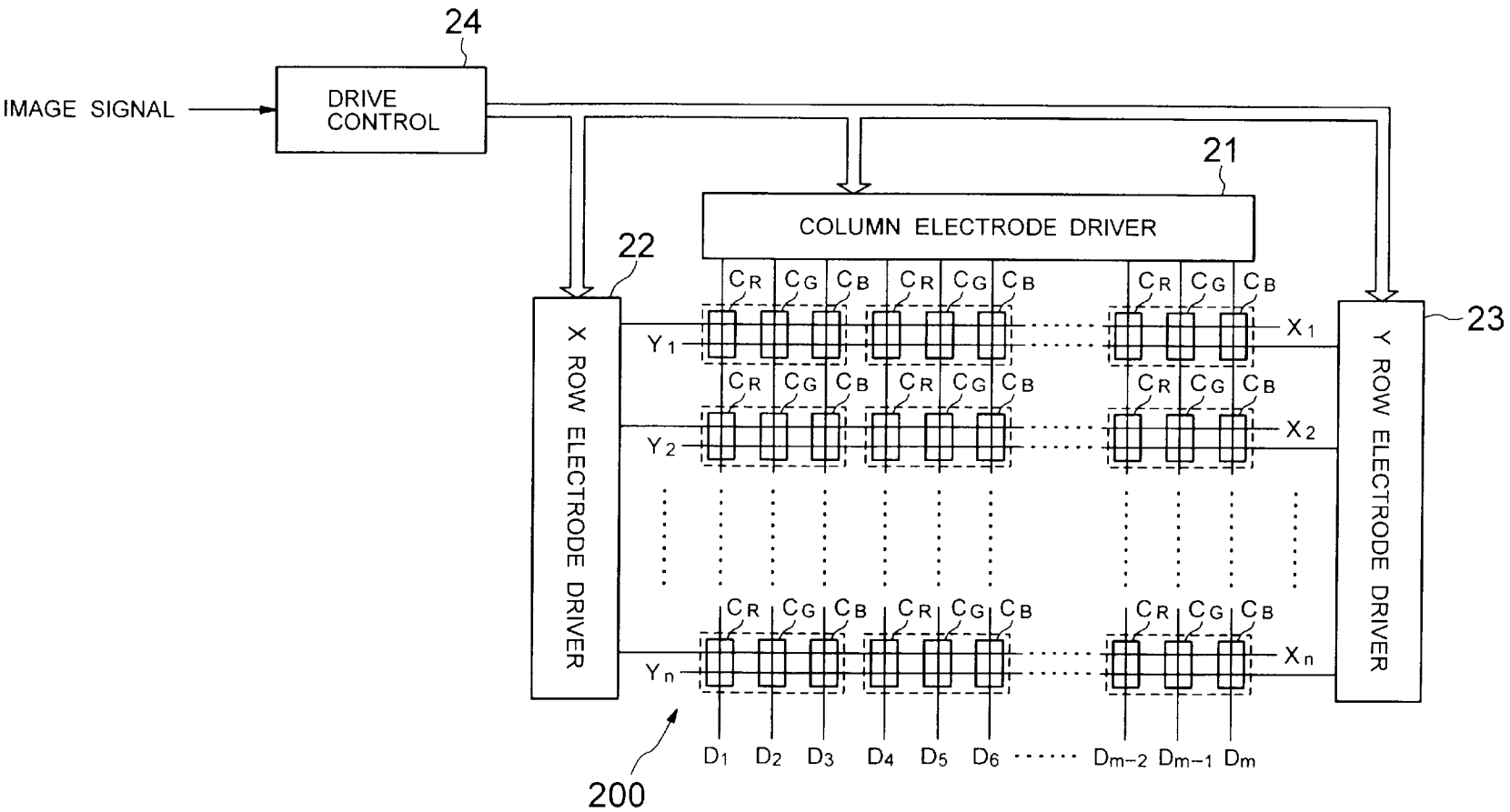
FIG. 5 shows a structure of a plasma display device wherein the PDP is driven in accordance with a drive method of one embodiment of the present invention.

FIG. 5 shows the structure of a plasma display device that drives a plasma display panel following a drive method according to one embodiment of the present invention.

In FIG. 5, a plasma display panel or PDP 200 includes m column electrodes $D_1$ to $D_m$, and n row electrodes $X_1$ to $X_n$ and n row electrodes $Y_1$ to $Y_n$, disposed so as to intersect with the column electrodes. These row electrodes $X_1$ to $X_n$ and row electrodes $Y_1$ to $Y_n$ define the first display line through the nth display line in the PDP 200 through each of the pairs of row electrodes $X_i$ ($1 \leqq i \leqq n$) and $Y_i$ ($1 \leqq i \leqq n$). The column electrodes $D_1$ to $D_m$ are divided into the column electrodes $D_1, D_4, D_7, \ldots, D_{m-2}$, which handle the red light emission, column electrodes $D_2, D_5, D_8, \ldots, D_{m-1}$, which handle the green light emission, and column electrodes $D_3, D_6, D_9, \ldots, D_m$, which handle the blue light emission. At the each intersection between the column electrodes D and the row electrodes X and Y, an discharge cell $C_R$ that emits red light (during the light emission or discharge), an discharge cell $C_G$ that emits green light, or an discharge cell $C_B$ that emits blue light is formed. The discharge cells $C_R$ are formed on the column electrodes $D_1, D_4, D_7 \ldots, D_{m-2}$, which are used to emit red light. The discharge cells $C_G$ are formed on the column electrodes $D_2, D_5, D_8 \ldots D_{m-1}$, which are used to emit the green light. The discharge cells $C_B$ are formed on the column electrodes $D_3, D_6, D_9 \ldots D_m$. As is shown in FIG. 5, three discharge cells (discharge cell $C_R$, discharge cell $C_G$, and discharge cell $C_B$), adjacent to each other in the display line direction, define a picture element cell that handles the display of a single picture element.

FIG. 6 through FIG. 9 show the details of the structure of the PDP 200.

Figure 6:
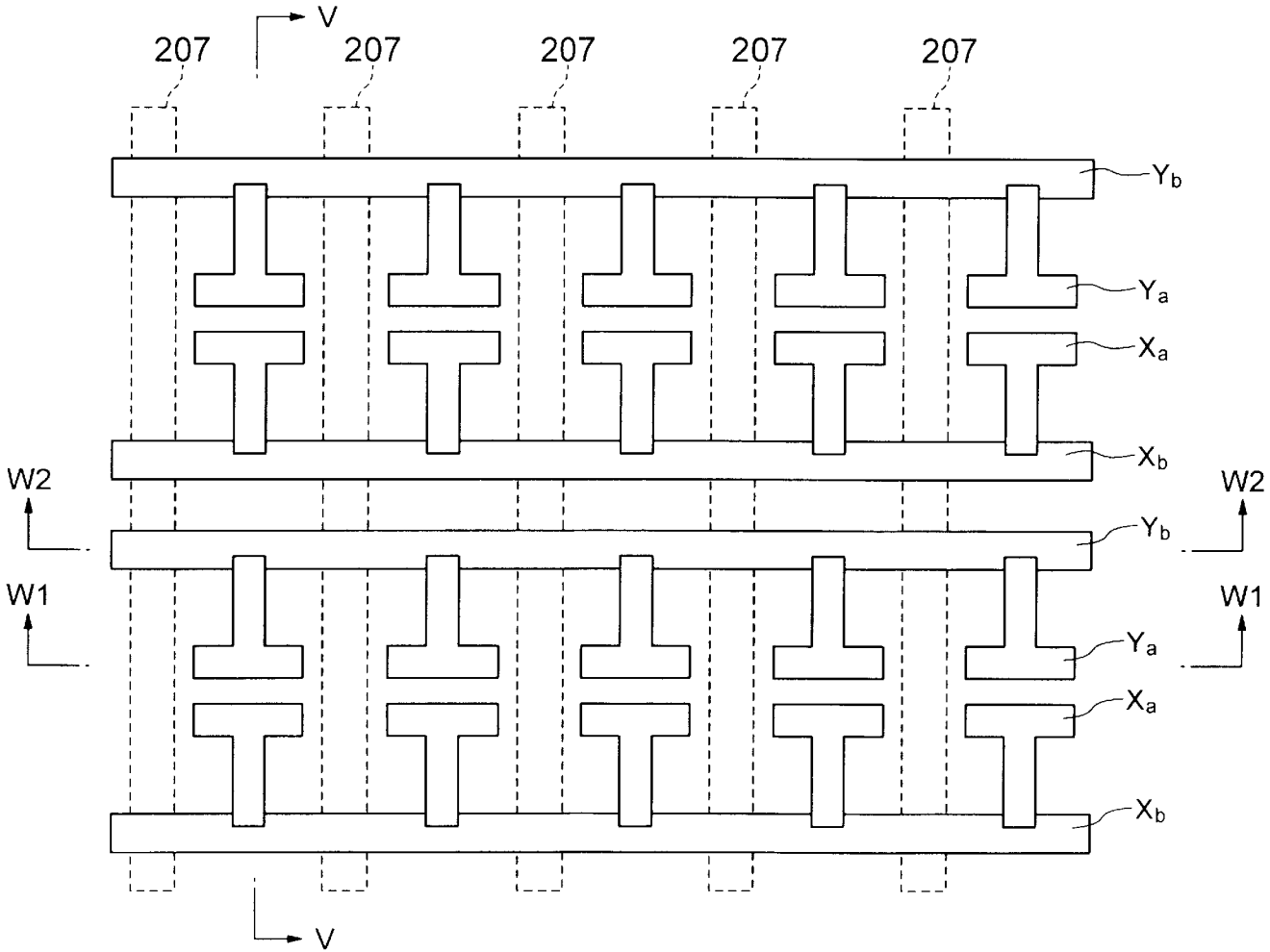
FIG. 6 is an orthonormal view of the PDP shown in FIG. 5 when viewed from the front of the PDP.
Figure 7:
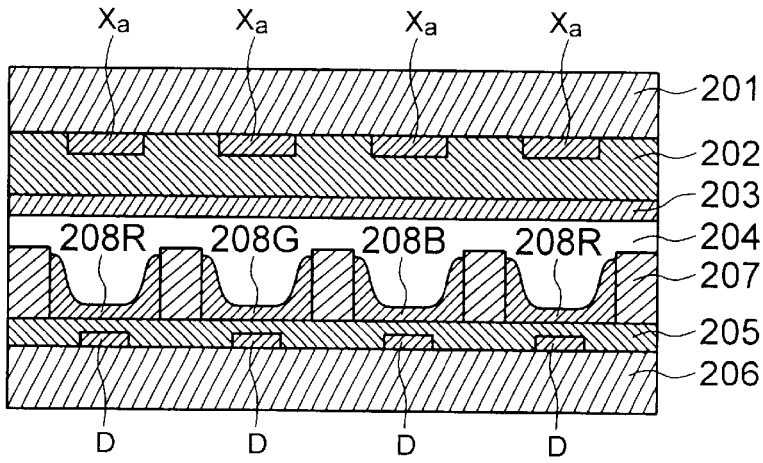
FIG. 7 is a drawing showing a cross sectional view taken along the line W1—W1 shown in FIG. 6.
Figure 8:
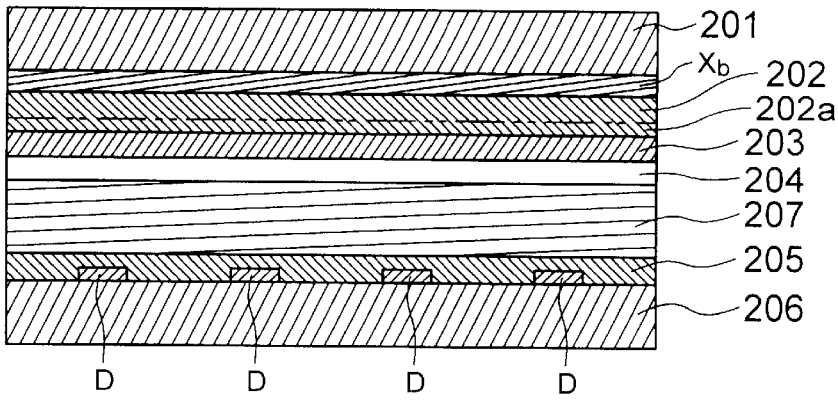
FIG. 8 is a drawing showing a cross sectional view taken along the line W2—W2 shown in FIG. 6.
Figure 9:
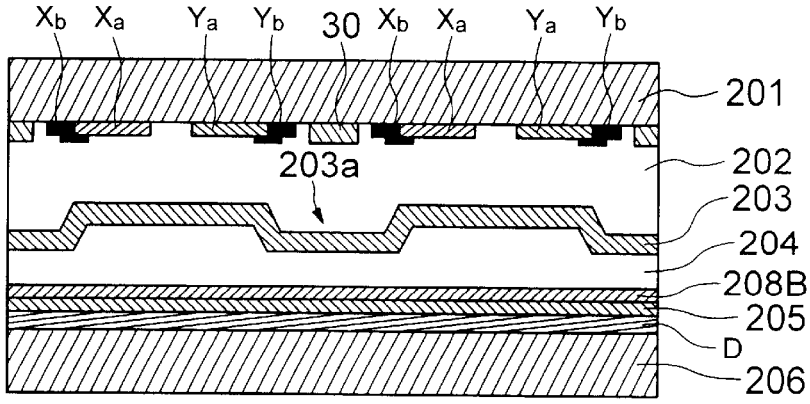
FIG. 9 is a drawing showing a cross sectional view taken along the line V—V shown in FIG. 6.

FIG. 6 is an orthonormal view of the PDP 200 when viewed from the front of the panel. FIG. 7 is a cross-sectional drawing of the section along the line W1—W1 shown in FIG. 6. FIG. 8 is a cross-sectional view taken along the line W2—W2 in FIG. 6. FIG. 9 is a cross-sectional view taken along the line V—V in FIG. 6.

As shown in FIG. 6, the row electrodes $X_1$ to $X_n$ each include a metal electrode Xb, which extends in the direction of a display line on the screen, and a plurality of (m units) T-shaped transparent electrodes Xa connected to the metal electrode Xb. The transparent electrodes Xa are formed at the positions of individual discharge cells C. In addition, the row electrodes $Y_1$ to $Y_n$ each include a metal electrode Yb, which extends in parallel with the electrodes Xb, and a plurality of (m units) T-shaped transparent electrodes Ya, which are connected to the metal electrode Yb. The transparent electrodes Ya are formed at locations of the individual discharge cells C. As shown in FIG. 6, the T-shaped transparent electrodes Xa and Ya are disposed so that the edges of the respective cross parts face each other across electrodischarge gaps with specific widths.

As is shown in FIGS. 7 through 9, the PDP 200 has a layered structure comprising a front transparent substrate 201, a dielectric layer 202, an MgO passivation (protection) layer 203, an electrodischarge space 204, a white dielectric layer 205, and a back substrate 206.

On the back surface of the front transparent substrate 201 that serves as the screen, the metal electrodes Xb and Yb are formed so as to extend in the direction of the display lines on the display. The metal electrodes Xb and Yb are parallel to each other. The dielectric layer 202 covers the row electrodes X, which include the metal electrodes Xb and the T-shaped transparent electrodes Xa, and also covers the row electrodes Y, which include the metal electrodes Yb and the T-shaped transparent electrodes Ya. As shown in FIG. 9, protrusions 203*a*, which protrude from the rest of the surface part, are formed in the dielectric layer 202 between adjacent metal electrodes Yb and between adjacent metal electrodes Xb. Because the protrusions 203*a* are provided, the discharge spaces that correspond to the individual discharge cells C located next to each other in the direction of the display lines are connected (communicated) with each other by gaps that are formed between partitions 207 and the passivation layer 203. Furthermore, in the region that is opposite the ribs 203*a* in the vicinity of the surface of the dielectric layer 202 is formed a shading layer 30 that increases the contrast by preventing the reflection of outside light. The passivation layer 203 is fabricated so as to cover said dielectric layer 202. Each of the column electrodes D are elongated in a direction perpendicular to the metal electrodes Xb and Yb on the contact surface with the white dielectric layer 205 on the back substrate 206. The discharge space 204 is filled with a mixture of rare gasses (mainly neon and/or xenon). The rare gases are the electrodischarge gas. Furthermore, the partitions 207 are fabricated so as to partition the discharge cells C, in the display line direction, within the discharge space 204. Between the partitions 207 on the surface of the white dielectric layer 205 are formed a red fluorescent material layer 208R, a green fluorescent material layer 208G, and a blue fluorescent material layer 208B so as to cover the side surfaces of these partitions 207 as well. The red fluorescent material layer 208R is formed between each two adjacent partitions 207 on the surface of the white dielectric layer 205 corresponding to the individual column electrodes $D_1$, $D_4$, $D_7 \ldots D_{m-2}$ that handle the emission of red light. The green fluorescent material layer 208G is formed between each two adjacent partitions 207 on the surface of the white dielectric layer 205 corresponding to the individual column electrodes $D_2$, $D_5$, $D_8 \ldots D_{m-1}$ that handle the emission of green light. The blue fluorescent layer 208B is formed between each two adjacent partitions 207 on the surface of the white dielectric layer 205 corresponding to the individual column electrodes $D_3$, $D_6$, $D_9 \ldots D_m$ that handle the emission of blue light.

When there is an electrical discharge in the vicinity of the electrodischarge gap between the T-shaped transparent electrodes Xa and Ya, ultraviolet light emitted from the electrical discharge causes the fluorescent material layer 208 to emit light in the color of the fluorescent material. At such a time, the electrical discharge that occurs in the vicinity of the electrodischarge gap spreads across the T-shaped transparent electrodes Xa and Ya, but the electrical discharge is weakened by the protrusions 203*a*. The spreading of the electrical discharge through the metal electrodes Xb and Yb to adjacent discharge cells C in the display line direction is blocked by the protrusions 203*a* and the partitions 207. The protrusions 203*a* suppress the spread of the electrical discharge, thereby preventing interference of the electrical discharge with the discharge cells C that are adjacent in the column direction and in the display line direction. This suppresses erroneous discharges.

Figure 1:
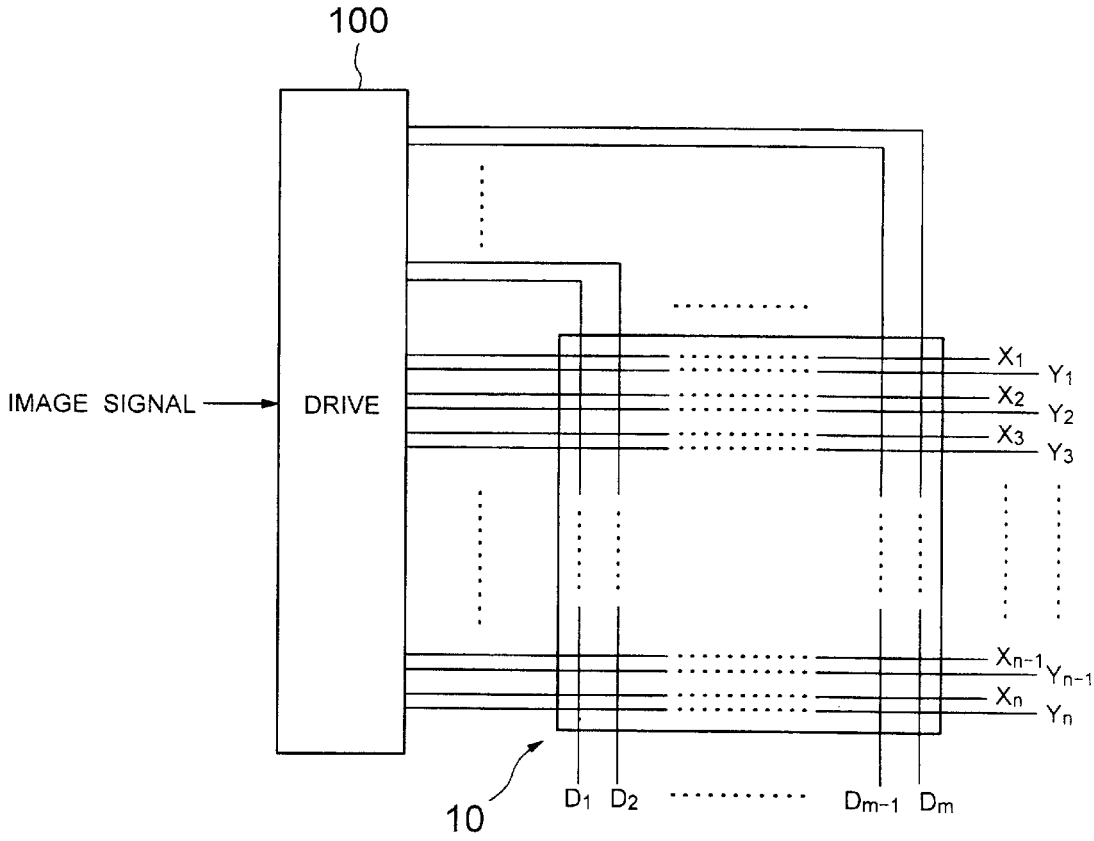
FIG. 1 is a drawing showing a schematic structure of a plasma display device.
Figure 2A:
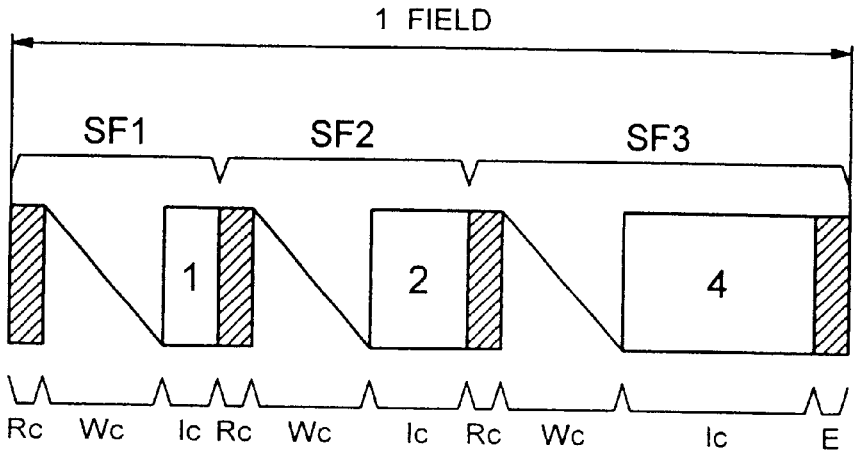
FIG. 2A is a drawing showing an example of a light-emission drive format.
Figure 2B:
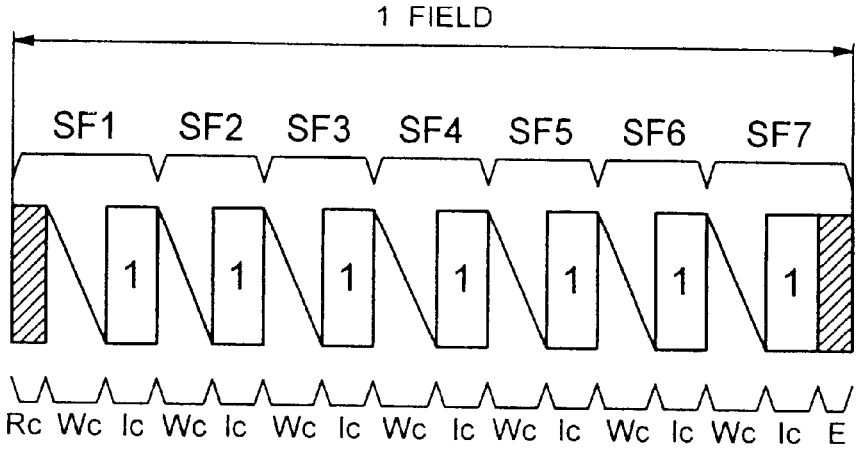
PRIOR ART FIG. 2B
FIG. 2B is a drawing showing another example of a light-emission drive format.

As shown in FIG. 5, the column electrode driver 21, the X row electrode driver 22 and the Y row electrode driver 23 apply drive pulses to the column electrodes $D_1$ to $D_m$, row electrodes $X_1$ to $X_n$, and row electrodes $Y_1$ to $Y_n$, respectively, to cause the reset discharges, selected discharges, and sustaining discharges, as described above, to occur in the individual discharge cells C. The drive control circuit 24 controls the column electrode driver 21, the X row electrode driver 22, and the Y row electrode driver 23 to apply the various drive pulses to the PDP 200 in accordance with the light-emission drive format as shown in FIG. 2A or FIG. 2B. At this time, either the selected erase address method or the selected write address method is used for driving the PDP 200.

When the selected erase address method is used, the reset discharges are caused in all of the discharge cells C during the full reset process Rc in the light-emission drive format shown in FIG. 2A or FIG. 2B to form a uniform wall charge in all of the discharge cells. Next, during the address process Wc, the discharges are caused selectively (selective erase discharges) in the discharge cells C of the respective display lines (one line at a time) according to the inputted image signal. At this time, the residual wall charge in the discharge cells in which selected erase electrodischarges have been caused is extinguished, thereby setting the discharge cells to the extinguished discharge cell state. On the other hand, the discharge cells in which the selected erase electrical discharge is not evoked retain the wall charge that has been formed in the full reset process Rc, and thus these discharge cells are set to the lit discharge cell state. During the light-emitting sustaining process Ic, a series of sustaining pulses, where the number of pulses depends upon the subfield concerned, is applied alternating between all of the pairs of row electrodes (X and Y) at the same time. The application of these sustaining pulses causes only the discharge cells wherein the wall charge remains, or in other words, those discharge cells that are set to be lit discharge cells, to discharge repetitively (sustaining discharge) for a period of time, which is determined by the subfield concerned. The light-emitting state continues as the sustaining discharges continue.

On the other hand, when the selective write address method is used, the reset discharges are first caused in all of the discharge cells C in the full reset process Rc to eliminate the residual wall charges in all of the discharge cells. Next, in the address process Wc, electrical discharges (selective write discharges) are caused selectively in the discharge cells C of the respective display lines (one line at a time) according to the inputted image signal. At this time, in those discharge cells wherein the selective write discharge is caused to occur, wall charges are formed within the discharge cells, thereby setting the discharge cells to be lit discharge cells. On the other hand, in other discharge cells in which the selective write electrical discharges are not caused to occur, no wall charge is formed, and these discharge cells are set as extinguished discharge cells. During the light-emission sustaining process Ic, sustaining pulses are applied alternately between all of the pairs of row electrodes (X and Y) at the same time, with the number of pulses specific to the subfield concerned. The application of these sustaining pulses causes only the discharge cells wherein the wall charge is remaining, or in other words, only the discharge cells set to the lit discharge cell state, to discharge repetitively (sustaining discharges) over the periods determined by the subfields concerned. The light-emitting state continues as the sustaining electrical discharges continue.

Figure 10:
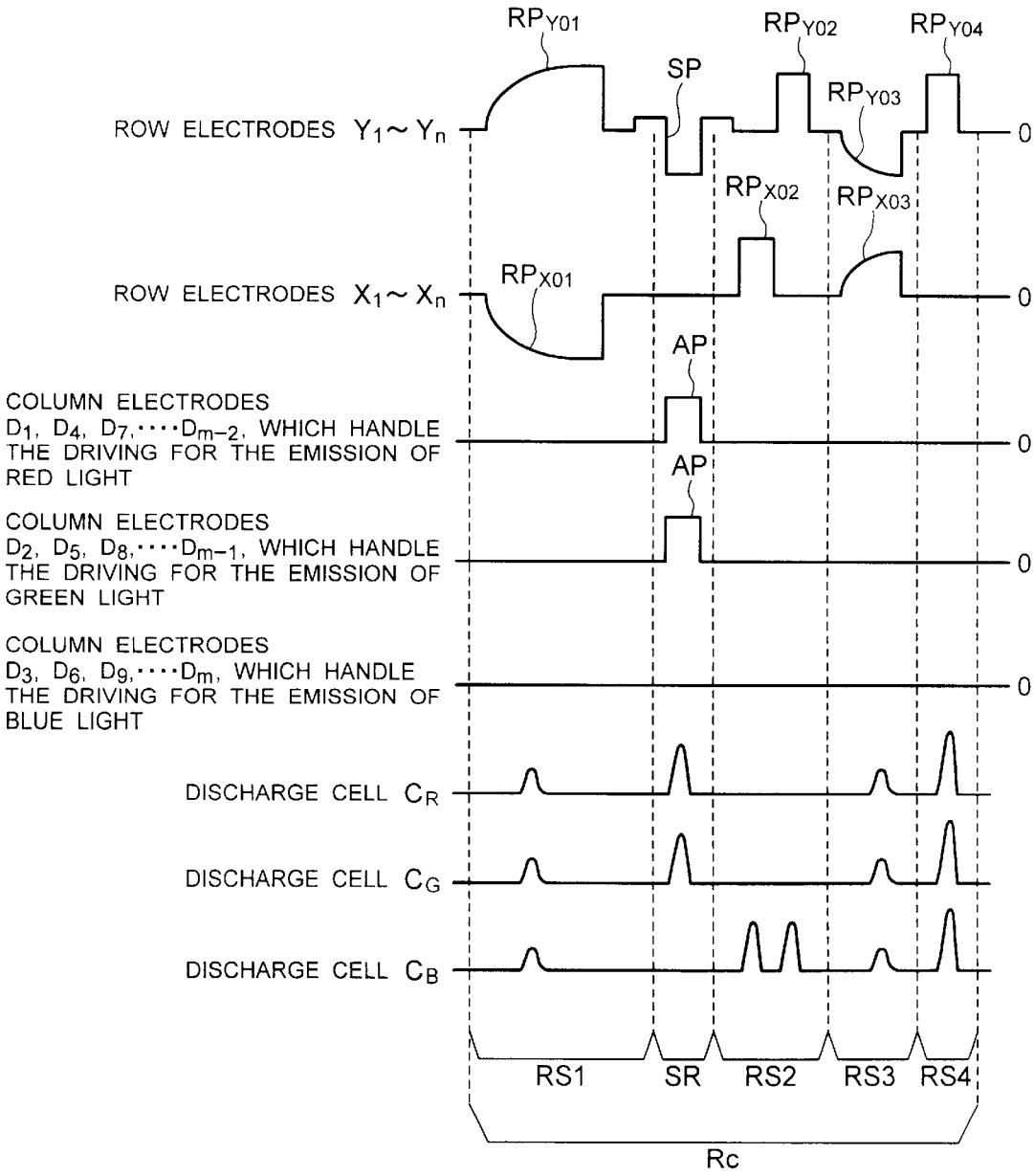
FIG. 10 shows various types of drive pulses that are applied to the PDP of FIG. 5 during the full reset process when the selective erase address method is used, together with the light-emission state of the discharge cells ($C_R$, $C_G$ and $C_B$)

FIG. 10 shows the light-emitting state of an electrode discharge cell and the application timing of the various drive pulses that are applied to the column electrodes $D_1$ to $D_m$ and the row electrodes $X_1$ to $X_n$ and $Y_1$ to $Y_n$ in the reset process Rc when the PDP 200 is operated with the selective erase address method.

In FIG. 10, the X row electrode driver 22 generates a first reset pulse $RP_{x01}$ that has negative polarity and that has a waveform wherein the falling edge is gradual compared to that of the sustaining pulse. The driver 22 then applies the first reset pulse to all of the individual row electrodes $X_1$ to $X_n$ at the same time. Simultaneously with the first reset pulse $RP_{x01}$, a Y row electrode driver 23 generates a first reset pulse $RP_{y01}$ that has positive polarity and that has a waveform wherein the rising edge is gradual compared to that of the sustaining pulse, and applies this first reset pulse $RP_{y01}$ to each of the row electrodes $Y_1$ to $Y_n$ at the same time (first reset RS1). The application of these first reset pulses $RP_{x01}$ and $RP_{y01}$ causes a relatively weak reset electrical discharge in all of the discharge cells, thereby causing extremely weak emissions from all the discharge cells $C_R$, $C_G$ and $C_B$, as shown in FIG. 10. After these reset electrical discharges, wall charges are formed in all the discharge cells $C_R$, $C_G$ and $C_B$.

Next, the Y row electrode driver 23 generates a simultaneous selection pulse SP, that has negative polarity as shown in FIG. 10, and applies this pulse to all the row electrodes $Y_1$ through $Y_n$ simultaneously. At the same time as this simultaneous selection pulse SP, the row electrode driver 21 applies address pulses AP, which have the opposite polarity of the simultaneous selection pulse SP, to the row electrodes $D_1, D_4, D_7 \ldots D_{m-2}$, which handle the emission of red light, and to the row electrodes $D_2, D_5, D_8 \ldots D_{m-1}$, which handle the emission of green light (selected erase SR). The application of the simultaneous selection pulse SP and address pulse AP causes an erase electrical discharge selectively (a selective erase electrodischarge) in only the discharge cells $C_R$ and $C_G$, thereby causing these discharge cells $C_R$ and $C_G$ to emit light as shown in FIG. 10. At this time, the selective erase electrodischarge eliminates the wall charge that had been held in the discharge cells $C_R$ and $C_G$.

Next, the X row electrode driver 22 generates a second reset pulse $RP_{x02}$ that as positive polarity, and applies the same to all of the individual row electrodes $X_1$ through $X_n$ simultaneously. After this second reset pulse $RP_{x02}$ is applied, the Y row driver 23 generates a second reset pulse $RP_{y02}$ that has positive polarity, and applies the same to the individual row electrodes $Y_1$ to $Y_n$ simultaneously (second reset RS2). Each time the second reset pulses $RP_{x02}$ and $RP_{yo2}$ are applied, reset electrical discharges are caused in the discharge cells $C_B$ only, so the discharge cells $C_B$ emit light continuously as shown in FIG. 10.

The X row electrode driver 22 generates a third reset pulse $RP_{x03}$ that has positive polarity and that has a waveform wherein the rising edge is gradual compared to that of the sustaining pulse, and applies the same to each of the row electrodes $X_1$ to $X_n$ at the same time. Simultaneous with this third reset pulse $RP_{x03}$, the Y row electrode driver 23 generates a third reset pulse $RP_{yo3}$ that has a negative polarity and that has a waveform wherein the falling edge is gradual compared to that of the sustaining pulse, and applies the same to each of the row electrodes $Y_1$ to $Y_n$ at the same time (third reset RS3). The application of these third reset pulses $RP_{x03}$ and $RP_{y03}$ causes a relatively weak reset electrical discharge to occur in all discharge cells, thereby causing an extremely weak emission of light, as shown in FIG. 10, from all discharge cells $C_R$, $C_G$ and $C_B$. Immediately following these reset electrical discharges, wall charges are formed in all of the discharge cells $C_R$, $C_G$ and $C_B$.

The Y row electrode driver 23 generates a fourth reset pulse $RP_{y04}$ that has positive polarity, and applies the same to each of the row electrodes $Y_1$ through $Y_n$ at the same time (fourth reset RS4). The application of this fourth reset pulse $RP_{yo4}$ causes an electrical discharge (wall charge adjustment discharge) in all discharge cells $C_R$, $C_G$ and $C_B$. This adjusts, to a desired amount, the amount of wall charge that is formed in the individual discharge cells ($C_R$, $C_G$ and $C_B$).

As described above, the driving in the full reset process Rc shown in FIG. 10 causes the formation of a uniform and desirable amount of wall charge in all discharge cells $C_R$, $C_G$ and $C_B$. Furthermore, each time the reset electrical discharges, selective erase electrical discharges, and wall charge adjustment electrical discharges are caused to occur by the first reset operation RS1 through fourth reset operation RS4 and the selective erase operation SR, priming particles are generated in the discharge space 204. These priming particles gradually accumulate in the discharge space 204. Finally (i.e., after the application of the fourth reset pulse $RP_{y04}$) priming particles are formed in the quantities that are sufficient to cause selected electrodischarges with stability in the address process Wc in the discharge spaces 204 in all discharge cells $C_R$, $C_G$ and $C_B$. The priming particles that are generated in the electrodischarge spaces 204 in the individual discharge cells C are spread evenly across the gap between the partitions 207 and the passivation layer 203, as shown in FIG. 7, thereby causing uniform and stable selected electrodischarges in any of the discharge cells C.

Here, the full rest process Rc of FIG. 10 has four electrodischarges in the discharge cells $C_R$ and $C_G$, and five electrical discharges in the discharge cell $C_B$. In short, the electrodischarge from the discharge cell $C_B$ emits light more often than the discharge cells $C_R$ and $C_G$. This is because the blue light that is emitted from the discharge cells $C_B$ is perceived as being inferior in brightness compared to the red or green emitted lights. In consideration of this, the number of times there are electrical discharges caused in the discharge cells $C_B$ is increased sufficiently so as to increase the amount of priming particles accumulated therein.

Figure 4A:
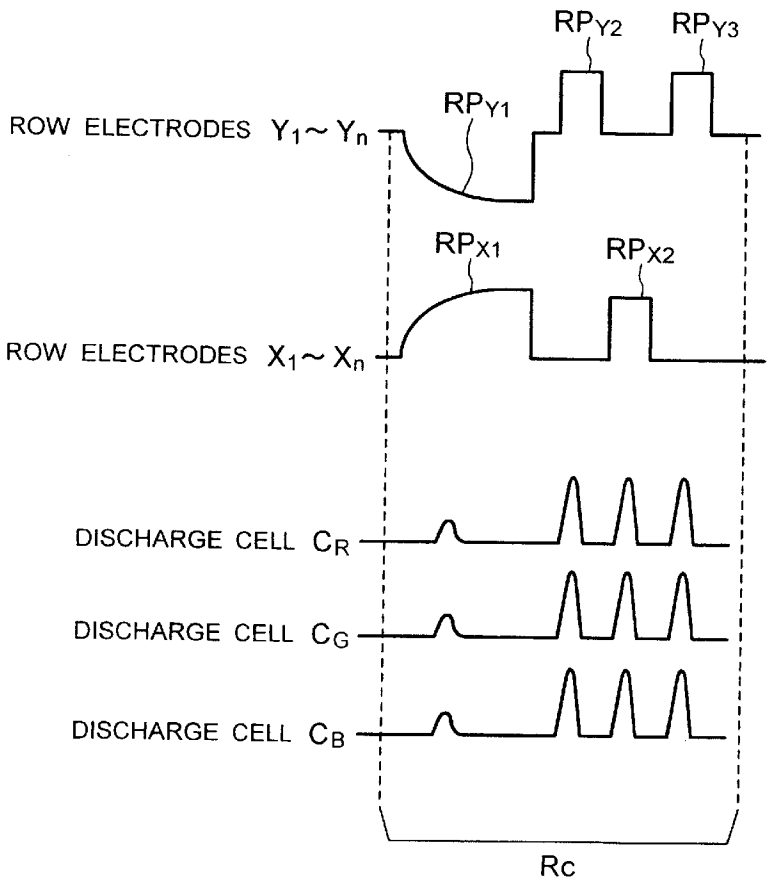
FIG. 4A illustrates reset pulses that are applied to a PDP (plasma display panel) in a full reset process, and timing of the application thereof.
Figure 4B:
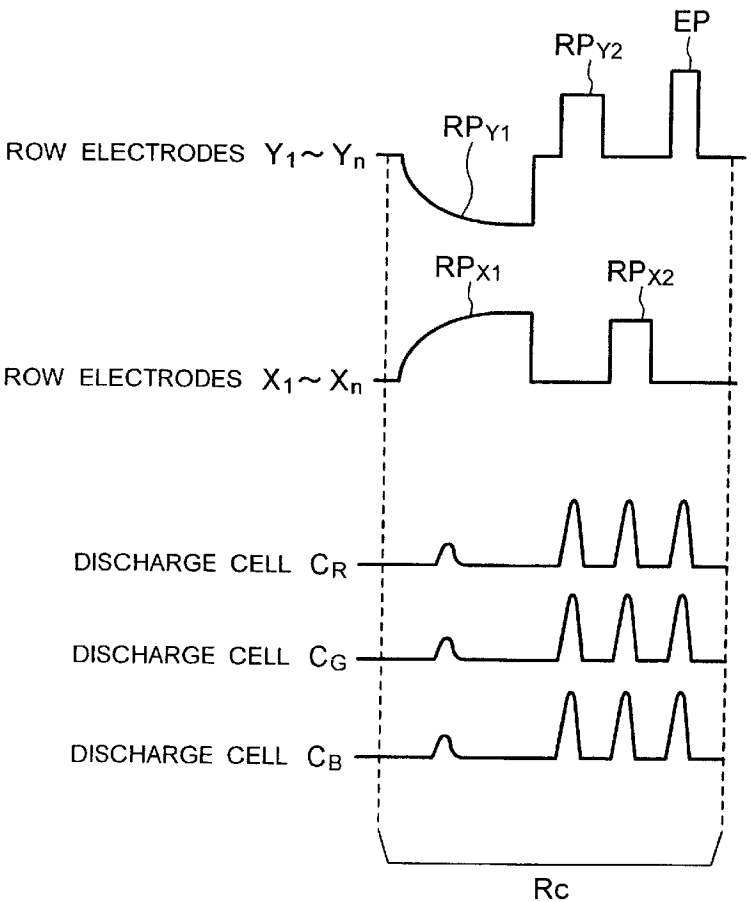
PRIOR ART FIG. 4B
FIG. 4B illustrates another reset pulses applied to the PDP in the full reset process, and the timing of the application thereof.

Consequently, the reset operation shown in FIG. 10 is able to produce the priming particles in the volume that is sufficient to produce stable selected electrical discharges during the address process Wc, even as the total amount of light emitted during the reset discharge is reduced through the use of the reset operation of FIG. 10, when compared to the case where the driving is done as shown in FIG. 4A or FIG. 4B. Consequently, through the use of this reset drive it is possible to cause stable selected electrical discharges in the address process Wc even while suppressing reductions in contrast.

Note that even though in the embodiment the number of electrical discharges caused in the discharge cells $C_R$ and $C_G$ during the full reset process Rc is less than the number of electrical discharges caused in the discharge cell $C_B$, it would also be acceptable to have the number of electrical discharges caused in the discharge cells $C_R$ and $C_B$ be fewer than the number of electrical discharges caused in the discharge cells $C_G$. Alternatively, it would be acceptable to have a number of electrical discharges caused in the discharge cells $C_G$ and $C_B$ be fewer than the number of electrical discharges caused in the discharge cells $C_R$, or the number of electrical discharges caused in the discharge cells $C_R$ be fewer than the number of electrical discharges caused in the discharge cells $C_B$ and $C_G$. Alternatively, it would also be acceptable to have the number of electrical discharges caused in the discharge cells $C_G$ be fewer than the number of electrical discharges caused in the discharge cells $C_B$ and $C_R$, or also acceptable to have the number of electrical discharges caused in the discharge cells $C_B$ be fewer than the number of electrical discharges caused in the discharge cells $C_G$ and $C_R$.

Essentially, by reducing the number of reset electrical discharges caused in the discharge cells that handle the emitted light of one color to a number that is less than the number of reset electrical discharges caused in the discharge cells that handle the emitted light of the other colors, it is possible to generate a sufficient amount of priming particles while reducing the total amount of light emitted in the reset electrical discharge light emissions.

Figure 11:
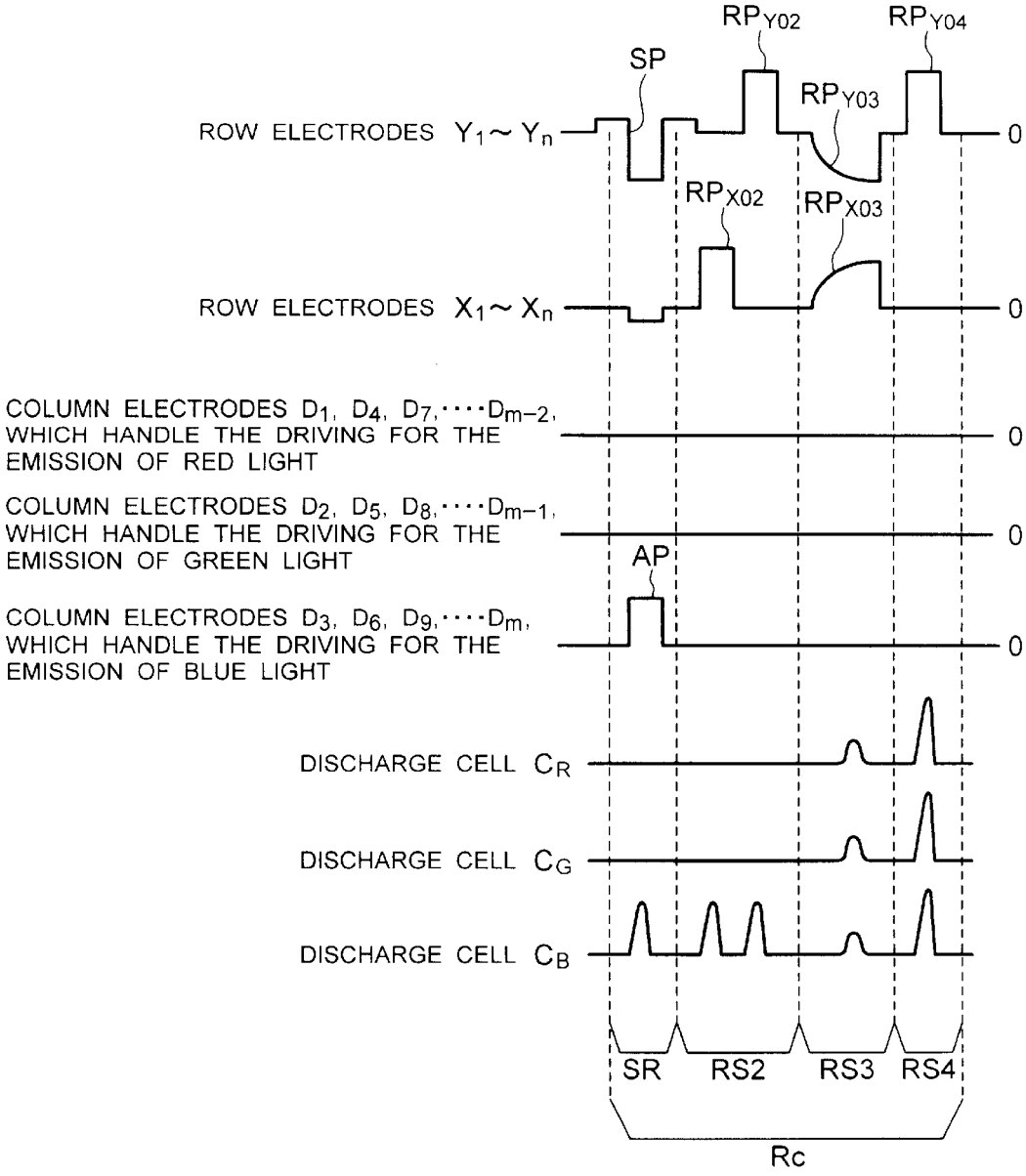
FIG. 11 shows another example of the various types of drive pulses that are applied to the PDP of FIG. 5 during the full reset process when the selective erase address method is used, together with the light-emission state of the discharge cells ($C_R$, $C_G$ and $C_B$)

Note that it is also acceptable to perform a reset drive as shown in FIG. 11 during the full reset process Rc, instead of the reset drive shown in FIG. 10.

In FIG. 11, the Y row electrode driver 23 first generates a simultaneous selection pulse SP with a negative polarity and applies the same to each of the individual row electrodes $Y_1$ to $Y_n$ simultaneously. At the same time as this simultaneous selection pulse SP, the column electrode driver 21 applies an address pulse AP with the opposite polarity as the simultaneous selection pulse SP, only to the individual column electrodes $D_3$, $D_6$, $D_9$, . . . $D_m$, which handle the emission of the blue light (selective write drive SW). The application of the simultaneous selection pulse SP and address pulse AP causes a write electrical discharge (selective write electrodischarge) selectively for the discharge cells $C_B$ only, thereby causing the discharge cells $C_B$ to emit light as shown in FIG. 11. The selective write electrodischarge causes the formation of a wall charge in the discharge cells $C_B$.

Next, the X row electrode driver 22 generates a second reset pulse $RP_{x02}$, with positive polarity, and applies the same to the individual row electrodes $X_1$ to $X_n$ simultaneously. After this second reset pulse $RP_{x02}$ is applied, the Y row electrode driver 23 generates a second reset pulse $RP_{y02}$, with positive polarity, and applies the same to each of the row electrodes $Y_1$ to $Y_n$ simultaneously (second reset drive RS2). Electrical discharges are caused in only the discharge cells $C_B$ each time the second reset pulses $RP_{x02}$ and $RP_{y02}$ are applied, thereby causing the discharge cells $C_B$ to emit light continuously as shown in FIG. 11.

The X row electrode driver 22 generates a third reset pulse $RP_{x03}$, which has a positive polarity and has a waveform where the rising edge is gradual when compared to that of the sustaining pulse, and applies the same to each of the row electrodes $X_1$ through $X_n$ simultaneously. At the same time as this third reset pulse $RP_{x03}$, the Y row electrode driver 23 generates a third reset pulse $RP_{y03}$, which has a negative polarity and has a waveform wherein the falling edge is gradual when compared to that of the sustaining pulse, and applies the same to the individual row electrodes $Y_1$ to $Y_n$ simultaneously (third reset drive RS3). The application of these third reset pulses $RP_{x03}$ and $RP_{y03}$ causes relatively weak reset electrical discharges in all of the discharge cells, and all of the discharge cells $C_R$, $C_G$ and $C_B$ emit an extremely weak light, as shown in FIG. 10. Directly following these reset discharges, wall charges are formed in all of the discharge cells $C_R$, $C_G$, and $C_B$.

Next the Y row electrode driver 23 generates a fourth reset pulse $RP_{y04}$, which has a positive polarity, and applies the same to the individual row electrodes $Y_1$ to $Y_n$ simultaneously (fourth reset drive RS4). The application of this fourth reset pulse $RP_{y04}$ causes electrical discharges (wall charge adjustment discharges) in all discharge cells $C_R$, $C_G$, and $C_B$, thereby adjusting to an amount (level) of the wall charge that is formed in the individual discharge cells ($C_R$, $C_G$, and $C_B$) to a desired level.

In this way, in the drive (operation) shown in FIG. 11, there are two electrical discharges caused in the discharge cells $C_R$ and $C_G$ and five electrical discharges caused in the discharge cells $C_B$, and the light that is generated in the electrical discharges caused during the full reset process Rc are small compared to the case shown in FIG. 10. Consequently, the reset drive (operation) shown in FIG. 11 will increase the contrast when compared with the reset drive shown in FIG. 10.

Figure 12:
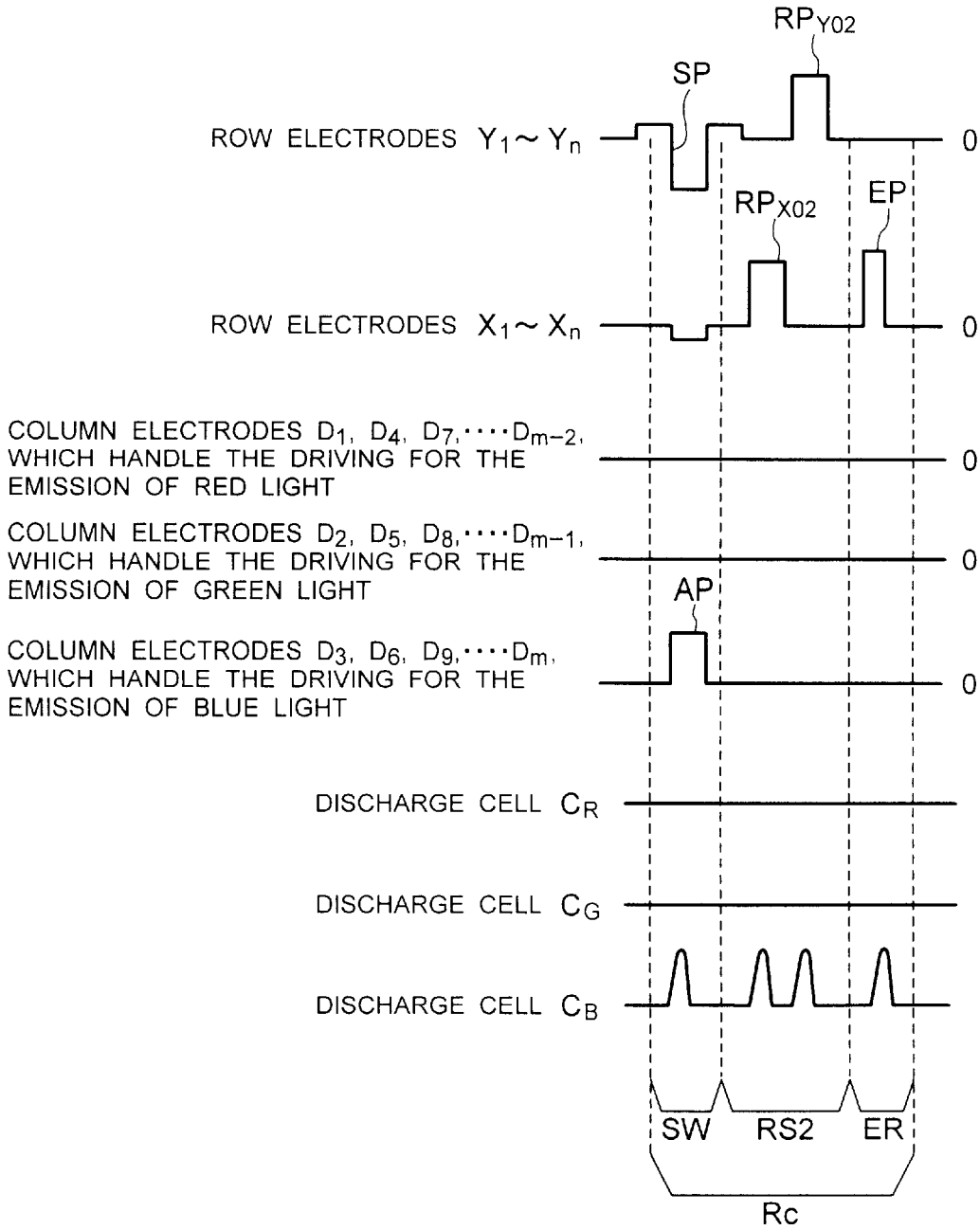
FIG. 12 illustrates various types of drive pulses that are applied to the PDP of FIG. 5 during the full reset process when the selective write address method is used, along with the light-emission state of the discharge cells ($C_R$, $C_G$ and $C_B$)

FIG. 12 shows the timing with which the various types of drive pulses are applied to the column electrodes $D_1$ to $D_m$ and to the row electrodes $X_1$ to $X_n$ and $Y_1$ to $Y_n$ in the reset process Rc when driving the PDP 200 using the selective write address method, and shows the light-emitting state of the discharge cells.

In FIG. 12, the Y row electrode driver 23 first generates a simultaneous selection pulse SP, which has a negative polarity, and applies the same to each individual row electrode $Y_1$ to $Y_n$ simultaneously. At the same time as this simultaneous selection pulse SP, the column electrode driver 21 applies an address pulse AP, with the polarity opposite that of the simultaneous selection pulse SP, to only column electrodes $D_3$, $D_6$, $D_9$, . . . $D_m$ which handle the driving for the emission of blue light (selected write drive SW). The application of the simultaneous selection pulse SP and the address pulse AP causes write electrical discharges (selected write electrodischarges) selectively for only the discharge cells $C_B$, thereby causing the discharge cells $C_B$ to emit light as shown in FIG. 12. The selected write discharges cause the formation of wall charges in the discharge cells $C_B$.

Next, the X row electrode driver 22 generates a second reset pulse $RP_{x02}$, with positive polarity, and applies the same to each individual row electrode $X_1$ to $X_n$ simultaneously. After this second reset pulse $RP_{x02}$ is applied, the Y row electrode driver 23 generates a second reset pulse $RP_{y02}$, with positive polarity, and applies the same to each individual row electrode $Y_1$ to $Y_n$ simultaneously (the second reset drive RS2). Electrical discharges are caused only in the discharge cells $C_B$ each time the second reset pulses $RP_{x02}$ and $RP_{y02}$ are applied, so the discharge cells $C_B$ continuously emit light as shown in FIG. 12.

Next, the X row electrode driver 22 produces an erase pulse EP with a short pulse width, as shown in FIG. 12, and applies the same to each individual row electrode $X_1$ to $X_n$ simultaneously (erase drive ER). The application of the erase pulse EP causes an erase discharge in all discharge cells, thereby eliminating the wall charges that have been formed in all discharge cells $C_R$, $C_G$, and $C_B$.

In the drive (operation) scheme shown in FIG. 12, therefore, the number of electrical discharges that are caused for the discharge cells $C_R$, and $C_G$ is 0, while the number of electrical discharges caused in the discharge cells $C_B$ is 4, so the amount of light emitted with the electrical discharges that occur during the full reset process Rc is small when compared to the cases in FIG. 10 and FIG. 11. Note that even though there are no electrical discharges at all in the discharge cells $C_R$, $C_G$ when the drive shown in FIG. 12 is used, the priming particles that are generated in the discharge space 204 of the discharge cells $C_B$ spread uniformly through the gap between the partition 207 and the passivation layer 203, as shown in FIG. 7. Consequently, even though no electrical discharges are caused in the discharge cells $C_R$ and $C_G$, priming particles exist in the electrical discharge spaces 204 in the discharge cells $C_R$, and $C_G$.

Figure 13:
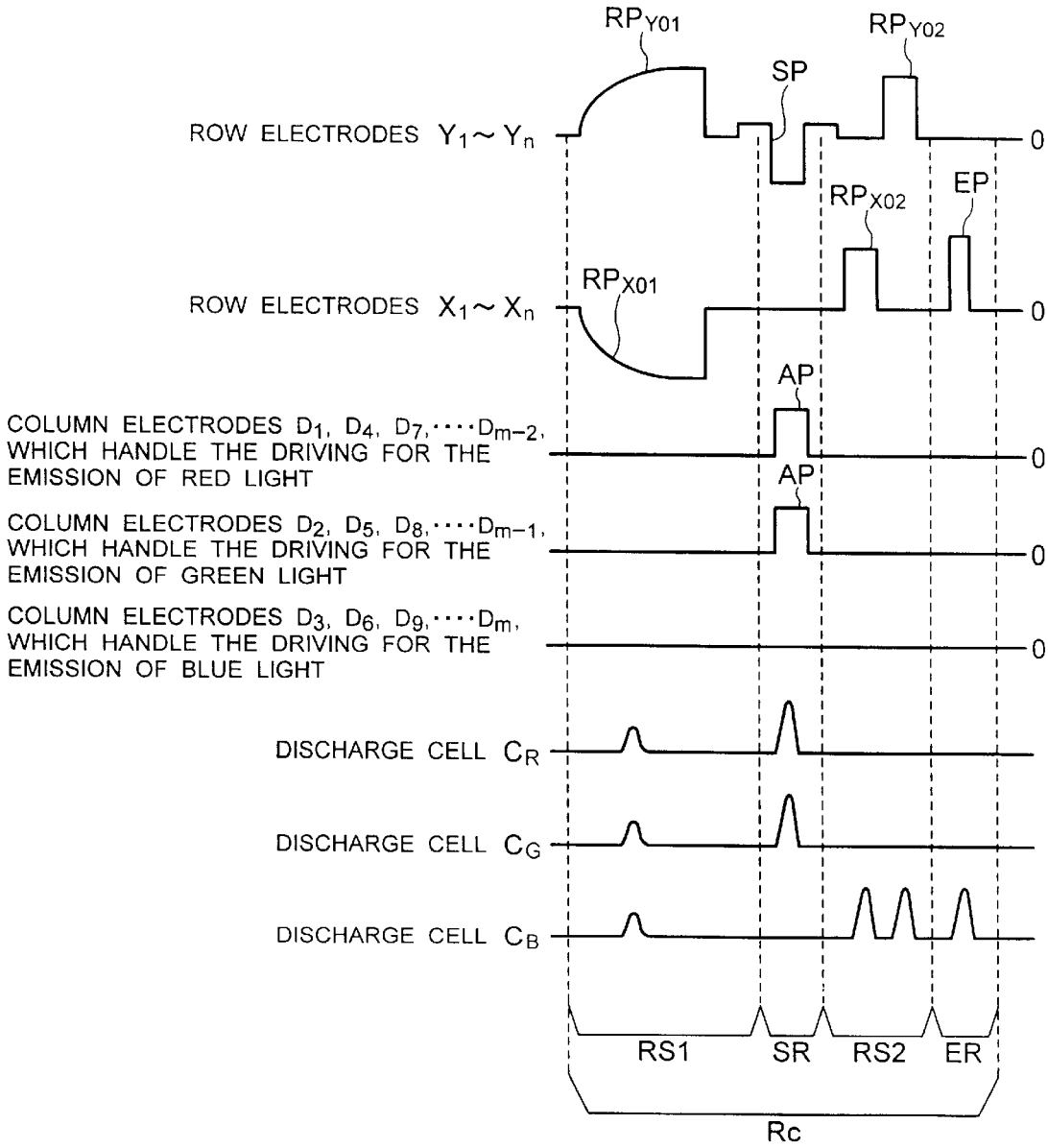
FIG. 13 illustrates another example of various types of drive pulses that are applied to the PDP of FIG. 5 during the full reset process when the selective write address method is used, along with the light-emission state of the discharge cells ($C_R$, $C_G$ and $C_B$).

It should be noted that when the selected write address method is used to drive the PDP 200, the reset drive as shown in FIG. 13 may be performed during the full reset process Rc.

In FIG. 13, the X row electrode driver 22 generates a first reset pulse $RP_{x01}$, which has negative polarity and which has a waveform wherein the falling edge is gradual when compared to that of the sustaining pulse, and applies the same to the individual row electrodes $X_1$ to $X_n$ simultaneously. At the same time as this first reset pulse $RP_{x01}$, the Y row electrode driver 23 generates a first reset pulse $RP_{y01}$, which has positive polarity and has a waveform wherein the rising edge is gradual when compared to that of the sustaining pulse, and applies the same to the individual row electrodes $Y_1$ to $Y_n$ simultaneously (first reset drive RS1).

The application of these first reset pulses $RP_{x01}$ and $RP_{y01}$ causes a relatively weak reset electrical discharge in all of the discharge cells, and all of the discharge cells $C_R$, $C_G$ and $C_B$, emit an extremely weak light as shown in FIG. 13. After this reset discharge, wall charges are formed in all discharge cells $C_R$, $C_G$ and $C_B$.

Next the Y row electrode driver 23 generates a simultaneous selection pulse SP, with a negative polarity as shown in FIG. 13, and applies the same to each individual row electrode $Y_1$ to $Y_n$ simultaneously. At the same time as this simultaneous selection pulse SP, the column electrode driver 21 applies an address pulse AP, with a polarity opposite of that of the simultaneous selection pulse SP, to column electrodes $D_2$, $D_5$, $D_8$, . . . , $D_{m-1}$, which handle the emission of green light, and to column electrodes $D_1$, $D_4$, $D_7$, . . . , $D_{m-2}$, which handle the emission of red light (selective erase drive SR). The application of the simultaneous selection pulse SP and address pulse AP causes erase discharges selectively (selective erase discharges) in the discharge cells $C_R$ and $C_G$ only, and these discharge cells $C_R$ and $C_G$ emit light as shown in FIG. 13. The selected erase discharge eliminates the wall charges that are remaining in the discharge cells $C_R$ and $C_G$.

Next, the X row electrode driver 22 generates a second reset pulse $RP_{x02}$ with a positive polarity, and applies the same to each of the individual row electrodes $X_1$ to $X_n$ simultaneously. After this second reset pulse $RP_{x02}$ is applied, the Y row electrode drive 23 generates a second reset pulse $RP_{y02}$, which has a positive polarity, and applies the same to each individual row electrode $Y_1$ to $Y_n$ simultaneously (second reset drive RS2). Electrical discharges are caused only in the discharge cells $C_B$ each time the second reset pulses $RP_{x02}$ and $RP_{y02}$ are applied, so the discharge cells $C_B$ continuously emit light as shown in FIG. 13.

Next the X row electrode driver 22 generates an erase pulse EP with a short pulse width, as shown in FIG. 13, and applies the same to each individual row electrode $X_1$ to $X_n$ simultaneously (erase drive ER). The application of the erase pulse EP causes erase discharges in all discharge cells, thereby eliminating the wall charges that are formed in all of the discharge cells $C_R$, $C_G$ and $C_B$.

It should be noted that that although in the above described embodiments the reset drives (operations) shown in FIG. 10 through FIG. 13 are performed in all of the full reset processes Rc shown in FIG. 2A and FIG. 2B, these need not necessarily be performed in all the full reset processes Rc. For example, as is shown in FIG. 2A, the reset drives shown in FIG. 10 through FIG. 13 may be performed in the full reset process Rc of only at least one of the subfields SF1 to SF3 shown in FIG. 2A, where conventional reset drives shown in FIGS. 4A/4B are performed in the full reset processes Rc for other subfield(s). It should be noted that it is also acceptable to perform the reset drive shown in FIGS. 10 through 13 in the full reset processes Rc for the subfields of only one of a plurality of fields, whereas the conventional reset drives shown in FIGS. 4A/4B are performed in the full reset processes Rc in the subfields of the other fields. Fundamentally, this performs a mixture of a reset drive wherein the number of reset discharges that are caused during the full reset process Rc are the same for all of the discharge cells that handle emission of each of the different colors (FIGS. 4A and 4B), and a reset drive wherein the number of reset discharges varies depending on the color of emitted light handled by the individual discharge cells (FIGS. 10 through 13).

This application claims priority of Japanese patent application No. 2001-152678, the entire disclosure of which is incorporated herein by reference.

What is claimed is:

1. A plasma display panel drive method of driving a plasma display panel for each of a plurality of subfields constituting a single field of an image signal, the plasma display panel including a plurality of picture elements, each picture element being constituted by a plurality of discharge cells with differing emission colors, the plasma display panel drive method comprising:

an address step that sets each of said discharge cells to either a lit discharge cell state or an extinguished discharge cell state by selectively causing said discharge cells to discharge in accordance with said image signal; and a sustaining step that causes only said discharge cells in said lit discharge cell state to have a specific number of sustain discharges corresponding to said subfields;

wherein said plasma display panel drive method further includes a reset step that initializes, for at least one of said subfields, all the discharge cells thereof to either said lit discharge cell state or said extinguished discharge cell state by causing all the discharge cells to continuously have a specific number of reset discharges prior to said address step;

wherein the number of said reset discharges caused in said discharge cells that handle light emission in at least one emission color in said picture element is, in at least one of said reset steps in said field, or in said reset steps in one field of a plurality of fields, greater than the number of said reset discharges caused in said discharge cells that handle light emission in other colors.

2. The plasma display panel drive method according to claim 1, wherein said at least one emission color in said picture element is a color having a relatively low visual brightness level.

3. The plasma display panel drive method according to claim 1, wherein said picture element comprises three discharge cells consisting of a red discharge cell that emits a red-colored light, a green discharge cell that emits a green-colored light and a blue discharge cell that emits a blue-colored light; and in said reset step, the number of said reset discharges caused in said blue discharge cells is greater than the number of said reset discharges caused in said red discharge cells and/or green discharge cells.

4. The plasma display panel drive method according to claim 1, wherein, in said reset step, said reset discharges are caused to occur only in said discharge cells that handle the light emission in at least one emission color in said picture element.

5. The plasma display panel drive method according to claim 4, wherein said at least one emission color in said picture element is blue.

6. The plasma display panel drive method according to claim 1, wherein said plasma display panel comprises:

a plurality of pairs of row electrodes that form display lines on a front substrate;

a dielectric layer that covers said row electrode pairs;

an electrical discharge space filled with an electrical discharge gas;

a back substrate facing said front substrate across said discharge space;

a plurality of column electrodes arrayed on said back substrate in a direction so as to intersect with said row electrode pairs;

a fluorescent material layer having colors and covering said column electrode such that each of the colors corresponds to each of said column electrodes; and partitions that partition said discharge space into regions respectively corresponding to said column electrodes; and wherein any one of a red discharge cell that emits red-colored light, a green discharge cell that emits green-colored light, and a blue discharge cell that emits blue-colored light is formed at each intersection part between said row electrode pairs and said column electrodes, and said intersection part includes said discharge space, said dielectric layer, and said fluorescent material layer in the vicinity of said row electrodes pairs and said column electrodes.

7. The plasma display drive method according to claim 6, wherein said picture element comprises three discharge cells consisting of said red discharge cell, said green discharge cell, and said blue discharge cell, disposed adjacent to each other in said display line direction.

8. The plasma display panel drive method according to claim 6, wherein two row electrodes in each of said row electrode pairs comprise transparent electrodes that face each other across a discharge gap, and metal electrodes that are respectively connected to said transparent electrodes, said transparent electrodes are formed independently for each of said discharge cells, and a surface of said dielectric layer on said metal electrode has a raised portion that is higher than other portions thereof.

9. The plasma display panel drive method according to claim 6, wherein said reset step comprises:

a first reset drive step that applies a first reset pulse between two row electrodes in each of said row electrode pairs to cause said reset discharges to occur in all of said red discharge cells, green discharge cells and blue discharge cells so as to create wall charges in all of the discharge cells;

a selective erase drive step that applies a simultaneous selection pulse to one of the two row electrodes in said each row electrode pair and also applies an address pulse, with a polarity that is the opposite of said simultaneous selection pulse, to only those column electrodes that correspond to said red discharge cells and said green discharge cells so as to cause erase discharges to occur in only said red discharge cells and said green discharge cells to eliminate the wall charges that had been created in said red discharge cells and said green discharge cells;

a second reset drive step that applies at least one second reset pulse between the two row electrodes in said each row electrode pair to cause said reset discharge to occur for said blue discharge cells only; and a third reset drive step that applies a third reset pulse between said two row electrodes in said each row electrode pair to cause said reset discharges to occur in all of said red discharge cells, said green discharge cells and said blue discharge cells so as to form wall charges within each of said red discharge cells, said green discharge cells and said blue discharge cells; and wherein said address step includes a step that selectively causes said red discharge cells, said green discharge cells and said blue discharge cells to have erase discharges in response to said image signal, thereby selectively eliminating said wall charges to cause the discharge cells which have had said erase discharge to change to said extinguished discharge cell state.

10. The plasma display panel drive method according to claim 9, wherein said first and third reset pulses have waveforms the rising edges of which are gentler compared to those of the sustaining pulses that are applied to said row electrode pairs in order to cause said sustaining discharges in said sustaining step.

11. The plasma display panel drive method according to claim 6, wherein said reset step comprises:

a first reset drive step that applies a first reset pulse between the two row electrodes of said each row electrode pair in order to cause said reset discharges to occur in all of the red discharge cells, the green discharge cells and the blue discharge cells so as to form wall charges in all of the discharge cells;

a selective erase drive step that applies a simultaneous selection pulse to one of the two row electrodes in said each row electrode pair, and applies an address pulse with a polarity opposite that of said simultaneous selection pulse only to said column electrodes that correspond to said red discharge cells and said green discharge cells in order to cause erase discharges to occur in only said red discharge cells and said green discharge cells, thereby eliminating the wall charges that have been formed in said red discharge cells and said green discharge cells;

a second reset drive step that applies at least one second reset pulse between the two row electrodes of said each row electrode pair to cause said reset discharges in only said blue discharge cells;

a third reset drive step that applies a third reset pulse between the two row electrodes of said each row electrode pair to cause said reset discharges to occur in all of said red discharge cells, said green discharge cells and said blue discharge cells so as to form wall charges in each of said red discharge cells, said green discharge cells and said blue discharge cells; and an erase drive step that applies an erase pulse to one of the two row electrodes of said each row electrode pair to cause erase discharges to occur in all of said red discharge cells, said green discharge cells and said blue discharge cells so as to eliminate the wall charges that have been formed in each of said red discharge cells, said green discharge cells and said blue discharge cells; and wherein said address step includes a step that creates said wall charges by selectively causing each of said red discharge cells, said green discharge cells and said blue discharge cells to have write discharges in response to said image signal, thereby causing transition of the discharge cells which have had write discharges to said lit discharge cell state.

12. The plasma display panel drive method according to claim 11, wherein said first reset pulse has a waveform the rising edge of which is gentler than that of the sustaining pulse that is applied to said row electrode pairs in order to cause said sustaining electrical discharges to occur in said sustaining step.

13. The plasma display panel drive method according to claim 6, wherein said reset step comprises:

a selective write drive step that applies a simultaneous selection pulse to one of the two row electrodes of said each row electrode pair, and applies an address pulse with a polarity that is opposite that of said simultaneous selection pulse to only said column electrodes that correspond to said blue discharge cells in order to cause write discharges to occur in only said blue discharge cells, thereby causing the formation of wall charges in only said blue discharge cells;

a second reset drive step that applies at least one second reset pulse between the two row electrodes of said each row electrode pair in order to cause said reset discharges to occur in only said blue discharge cells; and a third reset drive step that applies a third reset pulse between the two row electrodes in said each row electrode pair to cause said reset discharges to occur in all of said red discharge cells, said green discharge cells and said blue discharge cells in order to cause the formation of wall charges in each of said red discharge cells, said green discharge cells and said blue discharge cells; and wherein said address step includes a step that causes erase discharges to occur selectively in each of said red discharge cells, said green discharge cells and said blue discharge cells in response to said image signal, thereby selectively eliminating said wall charges to cause the transition of the discharge cells which have had said erase discharges to said extinguished discharge cell state.

14. The plasma display panel drive method according to claim 6, wherein said reset step comprises:

a selective write drive step that applies a simultaneous selection pulse to one of the two row electrodes in said each row electrode pair, and applies an address pulse with a polarity opposite to that of said simultaneous selection pulse to only those of said column electrodes that correspond to said blue discharge cells in order to cause write discharges to occur in only said blue discharge cells, thereby creating wall charges in only said blue discharge cells;

a second reset drive step that applies at least one second reset pulse between the two row electrodes of said each row electrode pair in order to cause said reset discharges to occur in only said blue discharge cells; and an erase drive step that applies an erase pulse to one of the two row electrodes in said each row electrode pair to cause erase discharges to occur in all of said red discharge cells, said green discharge cells and said blue discharge cells so as to eliminate the wall charges that have been created in said red discharge cells, said green discharge cells and said blue discharge cells; and wherein said address step includes a step for selectively causing write discharges to occur in each of said red discharge cells, said green discharge cells and said blue discharge cells, in response to said image signal, thereby causing the formation of said wall charges and the transition of the discharge cells which have had said write discharges to said lit discharge cell state.

* * * * *